US008231029B2

(12) United States Patent
Peer et al.

(10) Patent No.: US 8,231,029 B2
(45) Date of Patent: Jul. 31, 2012

(54) FLEXIBLE CONTAINER HAVING FLEXIBLE HANDLES

(75) Inventors: Syed M. Peer, Arlington Heights, IL (US); Kenneth R. Wilkes, Asheville, NC (US); Frederic W. Schuldt, Weaverville, NC (US)

(73) Assignee: Smart Bottle Inc., Asheville, NC (US)

( * ) Notice: Subject to any disclaimer, the term of this patent is extended or adjusted under 35 U.S.C. 154(b) by 197 days.

(21) Appl. No.: 12/712,544

(22) Filed: Feb. 25, 2010

(65) Prior Publication Data

US 2011/0056965 A1 Mar. 10, 2011

Related U.S. Application Data

(60) Provisional application No. 61/241,213, filed on Sep. 10, 2009.

(51) Int. Cl.
*B65D 25/28* (2006.01)
*B65D 33/10* (2006.01)

(52) U.S. Cl. ..... 220/754; 383/16

(58) Field of Classification Search ..... 220/754, 220/751, 23.86; 215/396, 395, 399; 383/16, 383/12, 8, 10, 7, 6, 906, 80; *B65D 25/30, B65D 25/28, 33/10, 33/08, 33/06*
See application file for complete search history.

(56) References Cited

U.S. PATENT DOCUMENTS 302,219 A * 7/1884 Andrews ..... 383/16
860,183 A * 7/1907 Barr ..... 383/16
1,596,355 A 8/1926 Hirsch
1,623,107 A 4/1927 Goodykoontz
2,072,225 A 3/1937 Slater
3,206,105 A 7/1965 Smith
3,306,327 A 2/1967 Ilg
3,367,380 A 2/1968 Dickey
3,380,646 A 4/1968 Doyen et al.
3,484,037 A 4/1968 Kugler
4,320,789 A 3/1982 Martin et al.

(Continued)

FOREIGN PATENT DOCUMENTS

GB 2456550 7/2009

(Continued)

OTHER PUBLICATIONS

International Search Report and Written Opinion issued May 3, 2010 for PCT Application No. PCT/US2010/25339.

(Continued)

*Primary Examiner* — Mickey Yu
*Assistant Examiner* — Robert J Hicks
(74) *Attorney, Agent, or Firm* — Jones Day

(57) ABSTRACT

A flexible container has flexible top and bottom handles for facilitating dispensing of a flowable substance stored therein. The container includes a flexible panels enclosing an interior of the container and forming a top segment, an opposite bottom segment, a front side segment, a rear side segment, and a pair of side segments bounding the interior. A rigid fitment provides an access opening through either the top segment or a front side segment. A flexible bottom handle structure surrounds a handle opening. It is defined by at least one of the flexible panels, the bottom handle structure being positioned along a center portion of the bottom segment between the front side and rear side segments. The bottom handle has a folded portion at the opening to provide a smooth gripping surface.

20 Claims, 7 Drawing Sheets

U.S. PATENT DOCUMENTS

| | | | | |
|---|---|---|---|---|
| 4,454,979 | A | 6/1984 | Ikeda et al. | |
| 4,467,588 | A | 8/1984 | Carveth | |
| 4,484,351 | A | 11/1984 | de Leeuwe et al. | |
| 4,872,766 | A * | 10/1989 | Dancy | 383/10 |
| 4,873,100 | A * | 10/1989 | Dirksing et al. | 426/111 |
| 4,911,562 | A | 3/1990 | Mazzeschi | |
| 5,050,742 | A | 9/1991 | Muckenfuhs | |
| 5,282,686 | A * | 2/1994 | Haber | 383/10 |
| 5,334,180 | A | 8/1994 | Adolf et al. | |
| 5,338,117 | A | 8/1994 | Kucksdorf et al. | |
| 5,406,650 | A | 4/1995 | Einbinder | |
| 5,624,048 | A | 4/1997 | Sander et al. | |
| 5,637,167 | A | 6/1997 | Krishnakumar et al. | |
| 5,685,454 | A | 11/1997 | Bonerb | |
| 5,758,473 | A | 6/1998 | Patelli | |
| 5,782,562 | A * | 7/1998 | Anspacher | 383/15 |
| 5,918,984 | A | 7/1999 | LaFleur et al. | |
| 6,276,579 | B1 * | 8/2001 | DeLoach | 224/148.3 |
| 6,287,289 | B1 | 9/2001 | Niedospial, Jr. | |
| 6,447,165 | B1 * | 9/2002 | Grewe | 383/121.1 |
| 6,549,744 | B2 | 4/2003 | Terazawa et al. | |
| 6,695,757 | B2 | 2/2004 | Edwards et al. | |
| 6,746,388 | B2 | 6/2004 | Edwards et al. | |
| 6,832,852 | B2 | 12/2004 | Wilkes | |
| 7,032,756 | B2 * | 4/2006 | Wylie | 206/509 |
| 7,147,597 | B2 | 12/2006 | Wilkes | |
| 7,350,657 | B2 | 4/2008 | Eaton et al. | |
| 7,407,326 | B2 | 8/2008 | Wilkes | |
| D608,656 | S | 1/2010 | Wilkes et al. | |
| 2003/0059130 | A1 | 3/2003 | Yoneyama et al. | |
| 2003/0202719 | A1 | 10/2003 | Wilkes | |
| 2005/0053313 | A1 | 3/2005 | Lucas et al. | |
| 2006/0188177 | A1 * | 8/2006 | Dyer et al. | 383/10 |
| 2006/0257057 | A1 * | 11/2006 | Andersen | 383/104 |
| 2007/0036471 | A1 | 2/2007 | Anasis et al. | |
| 2007/0047851 | A1 | 3/2007 | Sato et al. | |
| 2007/0071366 | A1 * | 3/2007 | Kao | 383/38 |
| 2007/0141876 | A1 * | 6/2007 | Lown et al. | 439/131 |
| 2007/0297700 | A1 | 12/2007 | Berman | |
| 2008/0085065 | A1 | 4/2008 | Nowak et al. | |
| 2008/0277308 | A1 | 11/2008 | Simhaee | |
| 2009/0097779 | A1 | 4/2009 | Branch | |
| 2009/0101699 | A1 | 4/2009 | Goudreau et al. | |

FOREIGN PATENT DOCUMENTS

| | | |
|---|---|---|
| JP | 09-10445 | 4/1997 |
| JP | 10059385 | 3/1998 |
| JP | 10278947 | 10/1998 |
| JP | 11049186 | 2/1999 |
| JP | 2000103439 | 4/2000 |
| JP | 2001114304 | 4/2001 |
| JP | 2001158443 | 6/2001 |
| JP | 2001240076 | 9/2001 |
| JP | 2001348065 | 12/2001 |
| JP | 2002211588 | 7/2002 |
| JP | 2002211590 | 7/2002 |
| JP | 2003191967 | 7/2003 |
| JP | 2004168341 A | 6/2004 |
| JP | 2005212884 | 8/2005 |
| JP | 2006001566 | 1/2006 |
| JP | 2006176138 | 7/2006 |
| JP | 2009137601 | 6/2009 |
| WO | WO 90/08704 | 8/1990 |
| WO | WO 03/018416 | 3/2003 |
| WO | 2004/054888 A1 | 7/2004 |

OTHER PUBLICATIONS

International Search Report and Written Opinion issued May 3, 2010 for PCT Application No. PCT/US2010/25348.

Web pages downloaded from Flexible Jug website at www.flexiblejug.com, copyright 2007-2008.

Picture of a prior art flexible bottle, downloaded from Smart Bottle, Inc. website at www.smartbottleinc.com.

Co-pending U.S. Appl. No. 12/565,177, filed Sep. 23, 2009.

Office Action issued Sep. 26, 2011 by USPTO for U.S. Appl. No. 12/565,177.

Office Action issued Mar. 15, 2012 by USPTO for U.S. Appl. No. 12/565,177.

* cited by examiner

FLEXIBLE CONTAINER HAVING FLEXIBLE HANDLES

CROSS-REFERENCE TO RELATED APPLICATION

This application claims the benefit of U.S. Provisional Application No. 61/241,213, filed Sep. 10, 2009, hereby incorporated herein by reference.

TECHNICAL FIELD

This application generally relates to a flexible container having flexible handles and, in particular, a flexible container having a flexible top and bottom handle for facilitating dispensing of a flowable substance stored therein.

BACKGROUND

Large containers for storing flowable food products used in food service or in bulk product sales typically are provided in a rigid jar, made out of a rigid plastic material, and with a large opening. The large opening may be as large as or almost as large as the container is wide. A rigid handle can be located on the side of such jar for transporting and for assistance in transferring the product from the jar. The large opening can allow the user to be able to reach inside with a spoon or other utensil and scrape any residual product from the interior of the jar in an effort to transfer all or substantially all of the product to another smaller container or cup and to ensure that nothing is wasted. However, such a large opening in the jar does not readily facilitate controlled pouring into smaller dosing cups or containers. In order to transfer to a smaller sized container, a user often has to insert a utensil or cup into the jar and scoop out the necessary amount to transfer. Not only is an extra object being introduced into the container, but the user's entire hand may be inserted through the opening or otherwise in contact with the existing product, both of which can lead to product contamination if the product stored therein is contacted.

Another type of large container or bag can be made out of a flexible plastic film material having a rigid spout or fitment attached. A top handle can be attached and may be made of a rigid material, such as a rigid plastic material, and can be positioned on top of the container adjacent the pour spout or attached to the pour spout itself. The rigid handle can assist in carrying the bag and can be used to assist in holding and directing the bag during product transfer. However, the rigid handle on a flexible container can interfere with pouring the product from the container. When the product is being transferred from the flexible container by holding the rigid handle adjacent to or on the pour spout, the flexible container may bend or buckle at the flexible material around the neck of the spout, thus restricting the opening at the neck and making product transfer difficult. Furthermore, in order to pour the product out of such a large container, the user often has to grab the bottom wall or surface of the container for additional support when inverting the container, which is not practical for maintaining a firm grip on the container.

Other flexible containers may have a lower and/or an upper gripping flap that is an extension of the bag material and further having at least two small finger holes therein. This type of flexible bag does not have a top wall since the sidewalls terminate in this upper gripping flap. The bag only has a bottom wall and upstanding sidewalls that come together at the top to form a seal or closed edge. Thus, because there is no top wall of the bag, the pour spout is located in a sidewall of the bag. The position of the pour spout hinders the complete evacuation of the product inside the bag. If the bag is inverted in an upside down position, or approximately 180 degrees, in an attempt to fully evacuate the bag contents by letting gravity act upon it, some of the product can get stuck adjacent the upper gripping flap of the bag and below the inverted spout, unable to be poured out through the spout.

If it is desired to evacuate all of the product from within the flexible bag having a side spout, then the user may release the upper gripping flap and use that hand to apply pressure to the flexible bag in an effort to squeeze out the remaining product. When squeezing the remaining product, the bag is often in an inverted position with the top of the bag generally perpendicular to the receiving receptacle below. In this position, the remaining product can be squeezed out of the spout but it may drip out onto a portion of the sidewall of the bag and/or a portion of the upper gripping flap, which are positioned below the spout when the bag Is inverted, before it is received into the intended receiving receptacle below. This can cause sanitary concerns because the product can become contaminated since the exterior of the bag may not be fully clean or sterile.

SUMMARY

A flexible container is provided with a plurality of flexible panels having at least two flexible handles. The two flexible handles comprise one top handle at a top end portion and one bottom handle at a bottom end portion, positioned generally at a center point, such as a center of gravity, of its respective end of the container to provide better control of the container when carrying or inverting the container to transfer the product out. The top and bottom handle structures can both surround a handle opening that can accommodate a user's hand for gripping while transporting or transferring the product therein, where the opening allows the entire hand to be inserted for better control of the container when pouring and transferring its contents. Moreover, both handles can be an extension of the body of the container, defined by at least one of the flexible panels, thus not requiring extra material for the handles and saving on manufacturing costs. Furthermore, the flexible top handle does not interfere with the transfer of liquid out of the container and through a rigid spout located in the top end portion and adjacent the top handle, due to its flexibility and ability to move with the container rather than constrict an opening in the rigid spout. The bottom handle can be folded underneath the bottom surface of the container to allow the container to stand upright and unsupported when in a rest position and at different content fill heights. The top handle is adjacent the pour spout through which the contents of the container are emptied. The top handle is in the same plane as the pour spout, which allows for better control at the upper surface when transferring. The positioning of the pour spout on the top end portion of the container allows for the container to be inverted upside down (i.e., about 180 degrees) for substantially complete product evacuation. The user can continue to hold the handles of the container while inverting the bag and positioning the opening of the spout in a position that is directly above the receiving receptacle without the handles crossing the food products path of exit from the spout.

The spout also can have an opening sized such that the user can easily pour the product from the container into a smaller sized receiving receptacle in a controlled fashion without the need to use other utensils or cups to remove the product. The opening of the spout is also sized to prevent a user from inserting their entire hand through the opening to contact the product stored therein.

Additionally, the top handle of the container may have a machine fold or score line along a portion of a pair of legs of the handle, which causes the handles to bend or fold to one side when in a rest position, (i.e., not transferring). If for any reason the product contents do not completely dispense while holding the container in an inverted position, the user can let go of the top handle to apply a force to the flexible container to squeeze out the additional contents. In doing so, the top handle will automatically fold back to one side of the container, due to the machine fold forcing it in that direction, to ensure that the top handle will clear the path of the product as it is squeezed out of the container and exits the spout into the receiving receptacle below. This can ensure that the product is evacuated from the container in a sanitary manner, without coming into contact with the top handle or any exterior portion of the container.

In one aspect, the container can be provided from multiple substrate films, such that each side panel and front and rear panel is made up of a separate web of film, for a total of four layers or, alternatively, only one web of film can be used. The top handle is an extension of the top end portion or segment and comprises all four layers as does the bottom handle, which is also an extension of its bottom segment. The layers are sealed together at the top and bottom segments to form the handle associated with it.

The bottom handle also can have a machine fold or score line to force it to fold in the same direction as the top handle. This provides for ease of dispensing when both handles fold the same way. The machine fold also aids the container to rest in a freestanding upright position on the folded bottom handle when not in use and stored on its bottom end. Typically, when multiple film layers are sealed together in this fashion, it is difficult for a flexible package to stand upright because all of the layers sealed together cause the bottom to be uneven and hence to tip over. However, with the combination of the machine fold crease, gussets, and a tack seal across the bottom handle at its intersection with the bottom segment, the bottom handle can assist the container to stand upright unsupported, especially after some of its contents have been evacuated and the container is not completely full.

Additionally, due to the flexible nature of the container and the fact that the container can be made having a smaller size or footprint yet still contain the same volume of product, a larger quantity of the flexible bags can be stacked and shipped versus the current rigid bottles. Thus, a savings in transportation costs can be realized by reducing the number of shipments that need to be sent or transported to customers. Moreover, the shift from current rigid food service jars to the flexible container disclosed herein also results in a reduction of container material as well as providing for efficient shelf space storage in comparison to the rigid jars.

DETAILED DESCRIPTION

A flexible container having a flexible top handle and a flexible bottom handle is provided for facilitating dispensing of a flowable substance stored therein, as illustrated in FIGS. 1-7. The flexible container has a plurality of flexible panels enclosing an interior of the container. The flexible panels are connected, such as by folds or seals, to form a top portion or segment, an opposite bottom portion or segment, a front side, a rear side and a pair of sidewalls or segments that bound the interior. The top segment can be defined by an upper end or portion of the sidewalls. Likewise, the bottom segment can be defined by an opposite end or portion of the sidewalls. The flexible bottom handle is positioned at a bottom end of the container, and is integrally formed with the bottom segment, and the flexible top handle is positioned at a top end of the container, and is integrally formed with the top segment. A rigid fitment or pour spout is located at the top segment providing an access opening through the top segment with the top handle positioned adjacent the pour spout. The top and bottom handles can both be grasped when inverting the container upon dispensing the flowable substance contained therein.

Figure 1:
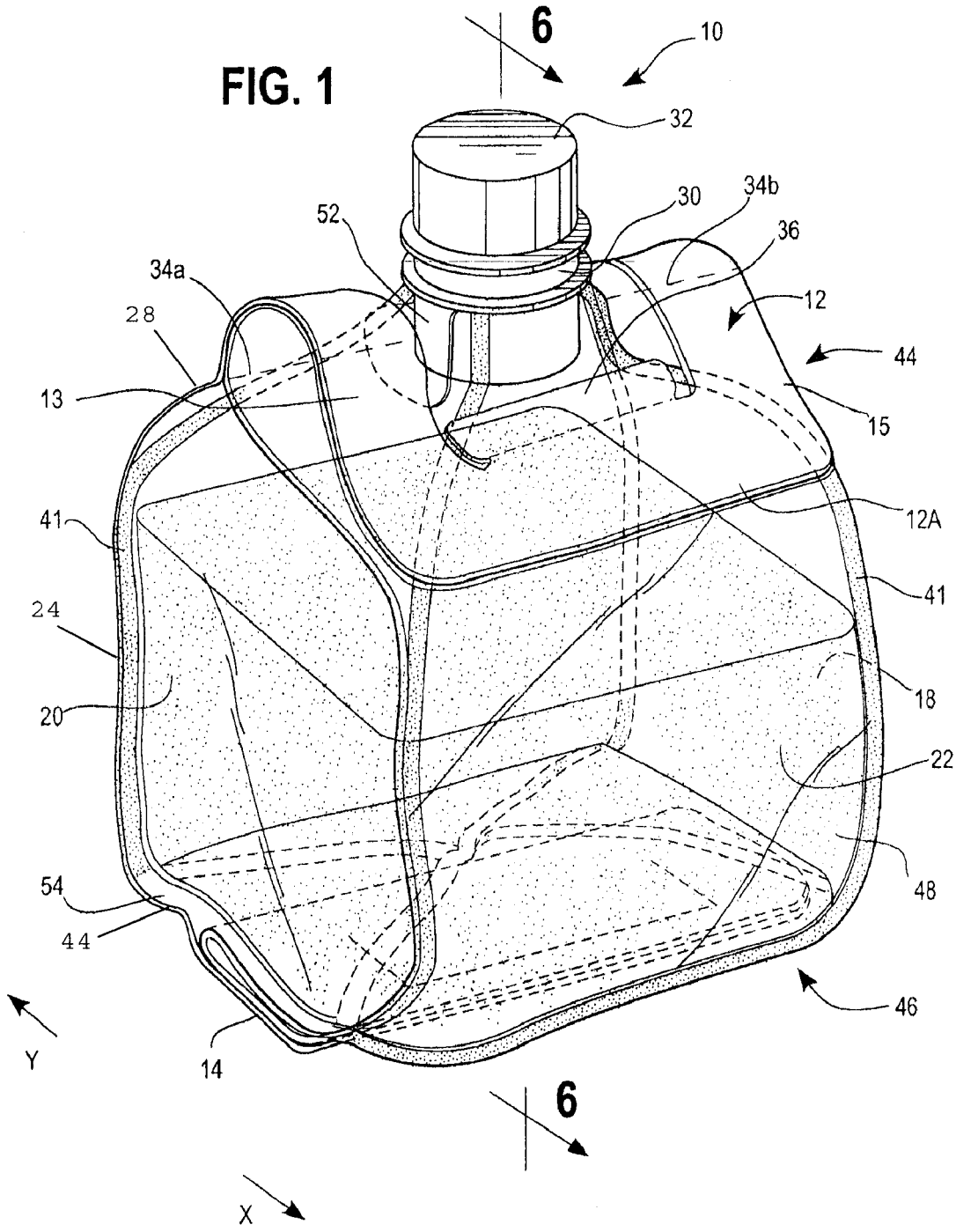
FIG. 1 is a perspective view of a filled flexible container having top and bottom flexible handles in a rest position.

Turning to FIG. 1, a flexible container 10 or bag with flexible top 12 and bottom 14 handles is illustrated. The container 10 can be a four-walled container having four side panels, a front side panel or segment 22, a back side panel or segment 24 and a pair of side panels or segments 18 and 20. The four side panels 18, 20, 22 and 24 can extend toward a top end 44 and a bottom end 46 of the container 10 to form the top segment 28 and bottom segment 26, respectively. When the container 10 is inverted, the top and bottom positions in relation to the container 10 change. However, for consistency the handle adjacent the spout 30 will be called the top or upper handle 12 and the opposite handle will be called the bottom or lower handle 14. Likewise, the top or upper portion, segment or panel will be the surface adjacent the spout 30, and the bottom or lower portion, segment, or panel will be the surface opposite the top segment. The four side panels 18, 20, 22 and 24 can each be made up of a separate web of film, such that a total of four webs of film can be provided, one for each side panel, or alternatively, up to six webs of film, one for each panel. Likewise, one web of film may also be used to make all four side panels and the top and bottom segments or, alternatively, any number of films can be used from one to six.

Where four webs of film are provided, the edges of each can be sealed to the adjacent web of film, such as by heat-sealing technology, to form sealed side edges 41 and sealed bottom edges 40 of the container 10. To form the top 28 and bottom 26 segments, the four webs of film converge together at the respective end and are sealed together. For instance, the top segment 28 can be defined by extensions of the side panels sealed together at the top end 44 and when the container 10 is in a rest position it can have four top panels 28*a*-28*d* (FIG. 4) of film that define the top segment 28. The bottom segment 26 can also have four bottom panels 26*a*-26*d* of film sealed together and can also be defined by extensions of the side panels at the opposite end 46.

Additionally, a fitment, such as a pour spout 30, can be positioned on the top segment 28, the fitment 30 having an access opening 50 through the top segment 28 to the interior. Alternatively, the fitment 30 can be positioned on one of the side panels, where the top segment would then be defined as an upper seal area defined by the joining together of at least two side panel ends. In one aspect, the pour spout 30 is positioned at generally a midpoint of the top segment 28 and can be sized smaller than a width of the container 10, such that the access opening 50 of the pour spout 30 can have an area that is less than a total area of the top segment 28. In another aspect, the spout area is not more than 20% of the total top segment area. This can ensure that the spout 30 and its associated access opening 50 will not be large enough to insert a hand therethrough, thus avoiding any unintentional contact with the product 58 stored therein.

A portion of the four webs of film that make up the top segment surface can also terminate at the spout 30. For instance, a portion of an end section of the four webs of film can each be sealed or welded to an outer, lower rim 52 of the pour spout 30 to form a tight seal. Furthermore, the spout 30 can contain a removable closure 32.

Figure 2:
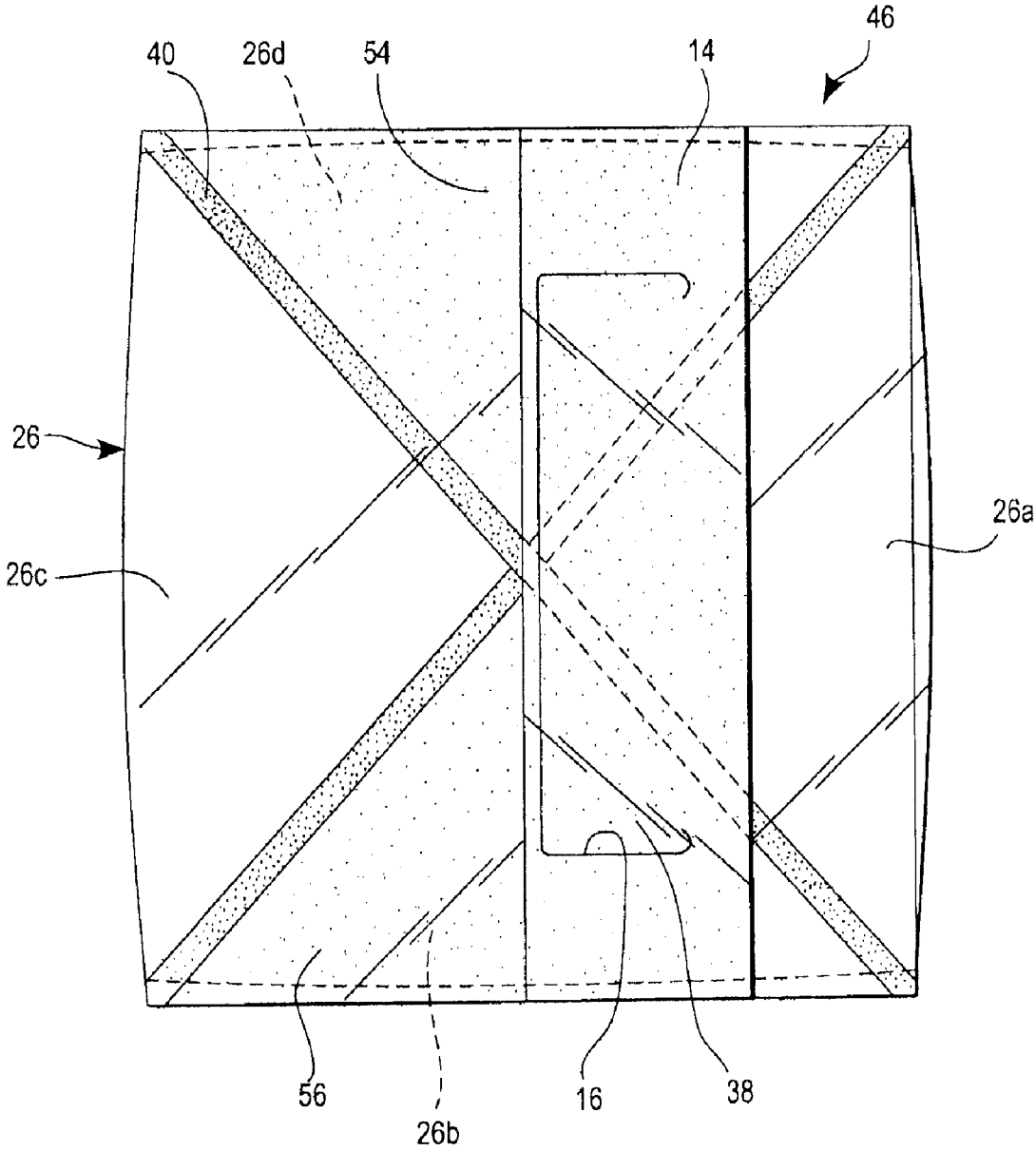
FIG. 2 is a bottom plan view of the flexible container of FIG. 1.

As shown in FIGS. 1-2, the flexible bottom handle 14 can be positioned at a bottom end 46 of the container 10 such that the bottom handle 14 can be an extension of the bottom segment 26 and, in particular, can be an extension of the four film panels 26*a*-26*d* that make up the bottom segment 26, as shown in FIG. 2. The four panels 26*a*-26*d* can come together at generally a midpoint of the bottom segment 26 and can be sealed together, such as by using a heat-sealing technology, to form the bottom handle 14. For instance, a weld can be made to form the bottom handle 14, and to seal the edges of the bottom segment 26 together.

Furthermore, the bottom segment 26 can have a pair of gussets 54 and 56 formed thereat, which are essentially extensions of the bottom segments panels 26*a*-26*d*. The gussets 54 and 56 can facilitate the ability of the container 10 to stand upright. These gussets 54 and 56 are formed from excess material from each bottom segment panel 26*a*-26*d* that are joined together to form the gussets 54 and 56. The triangular portions of the gussets 54 and 56 comprise two adjacent bottom segment panels sealed together and extending into its respective gusset. For example, adjacent bottom panels 26*a* and 26*d* extend beyond the plane of their bottom surface along an intersecting edge and are sealed together to form one side of a first gusset 54. Similarly, adjacent portions 26*c* and 26*d* extend beyond the plane of their bottom surface along an intersecting edge and are sealed together to form the other side of the first gusset 54. Likewise, a second gusset 56 is similarly formed from adjacent bottom segment panels 26*a*-26*b* and 26*b*-26*c*. The gussets 54 and 56 can contact a portion of the bottom segment 26, where the gusset portions gussets 54 and 56 can contact bottom segment panels 26*b* and 26*d* covering them, while bottom segment panels 26*a* and 26*c* remain exposed at the bottom end 46.

As shown in FIGS. 1-2, the gussets 54 and 56 of the container 10 can further extend into the bottom handle 14. In the aspect where the gussets 54 and 56 are positioned adjacent bottom segment panels 26*b* and 26*d*, the bottom handle 14 can also extend across bottom segment panels 26*b* and 26*d*, extending between the pair of sidewalls 18 and 20. The bottom handle 14 can be positioned along a center portion or midpoint of the bottom segment 26 between the front side panel 22 and the rear side panel 24.

The bottom handle 14 can comprise up to four layers of film sealed together when four webs of film are used to make the container 10. Any portion of the bottom handle 14 where all four layers are not completely sealed together by the heat-sealing method, can be adhered together in any appropriate manner, such as by a tack seal to form a fully-sealed multi-layer bottom handle 14. The bottom handle 14 can have any suitable shape and generally will take the shape of the film end. For example, typically the web of film has a rectangular shape when unwound, such that its ends have a straight edge. Therefore, the bottom handle 14 would also have a rectangular shape.

Figure 3:
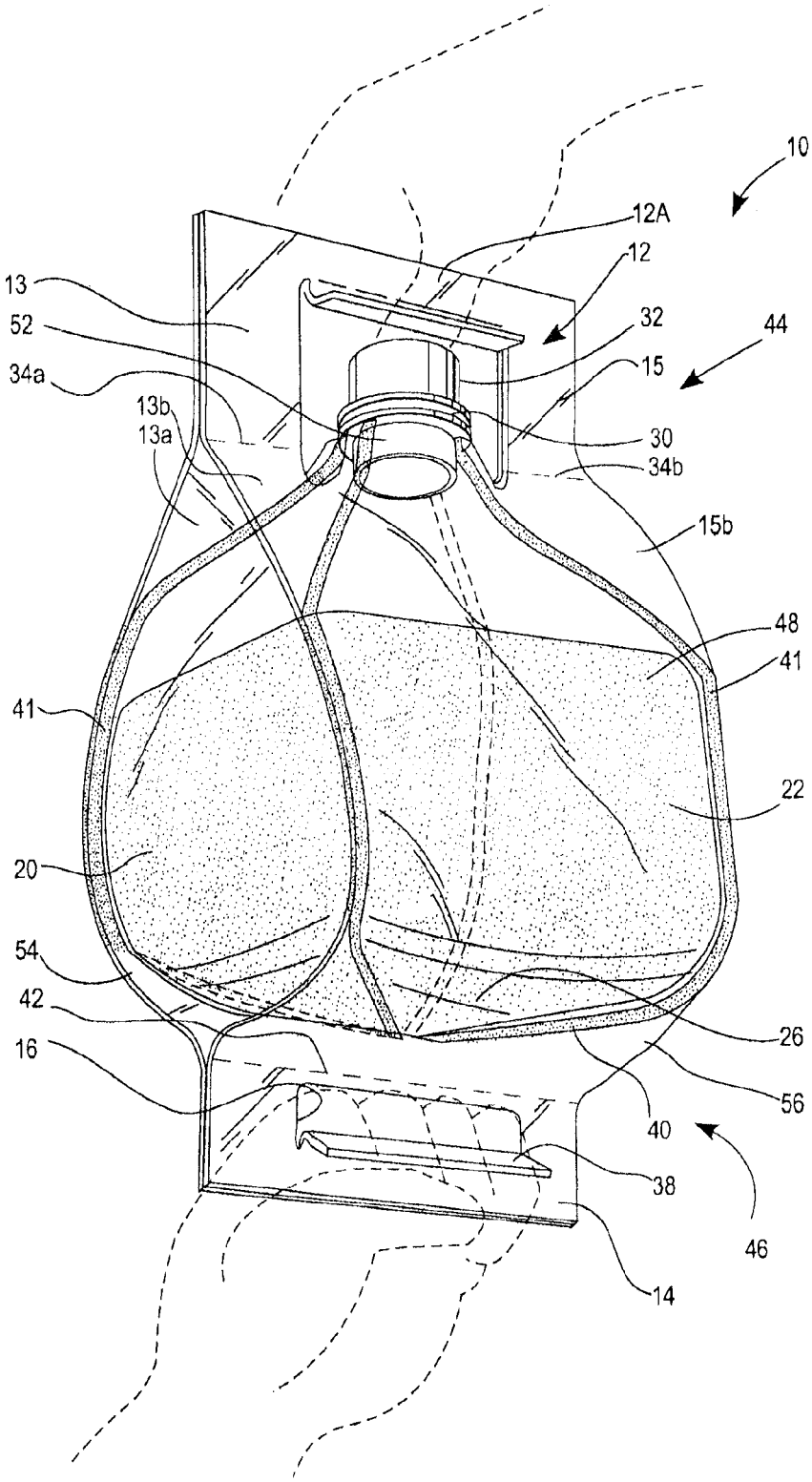
FIG. 3 is a perspective view of the flexible container of FIG. 1 shown with its top and bottom handles extended.

Additionally, the bottom handle 14 can contain a handle opening 16 or cutout section therein sized to fit a user's hand, as can be seen in FIG. 3. The opening 16 can be any shape that is convenient to fit the hand and, in one aspect, the opening 16 can have a generally oval shape. In another aspect, the opening 16 can have a generally rectangular shape. Additionally, the opening 16 of the bottom handle 14 can also have a flap 38 that comprises the cut material that forms the opening 16. To define the opening 16, the handle 14 can have a section that is cut out of the multilayer handle 14 along three sides or portions while remaining attached at a fourth side or lower portion. This provides a flap of material 38 that can be pushed through the opening 16 by the user and folded over an edge of the opening 16 to provide a relatively smooth gripping surface at an edge that contacts the user's hand. If the flap of material were completely cut out, this would leave an exposed fourth side or lower edge that could be relatively sharp and could possibly cut or scratch the hand when placed there.

Figure 6:
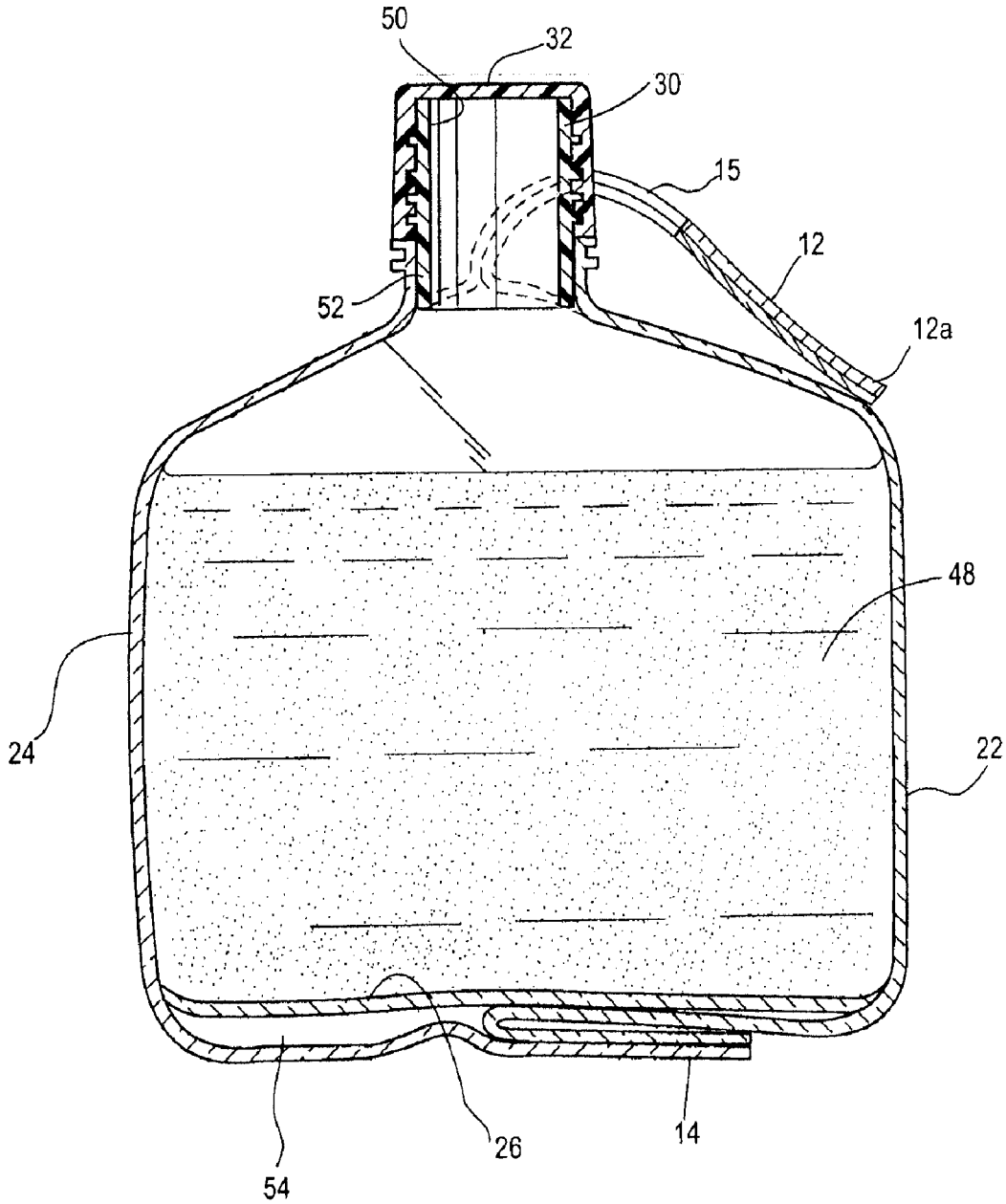
FIG. 6 is a cross-sectional view taken along the line 6-6 of FIG. 1.

Furthermore, a portion of the bottom handle 14 attached to the bottom segment 26 can contain a dead machine fold 42 or a score line that provides for the handle 26 to consistently fold in the same direction, as illustrated in FIGS. 1 and 3. The machine fold 42 can comprise a fold line that permits folding in a first direction toward the front side panel 22 and restricts folding in a second direction toward the rear side panel 24. The term "restricts" as used throughout this application can mean that it is easier to move in one direction, or the first direction, than in an opposite direction, such as the second direction. The machine fold 42 can cause the handle 14 to consistently fold in the first direction because it can be thought of as providing a generally permanent fold line in the handle that is predisposed to fold in the first direction X, rather than in the second direction Y. This machine fold 42 of the bottom handle 14 can serve multiple purposes, one being that when a user is transferring the product from the container 10 they can grasp the bottom handle 14 and it will easily bend in the first direction X to assist in pouring. Secondly, when the container 10 is stored in an upright position, the machine fold 42 in the bottom handle 14 encourages the handle 14 to fold in the first direction X along the machine fold 42, such that the bottom handle 14 can fold underneath the container 10 adjacent one of the bottom segment panels 26*a*, as shown in FIG. 6. The weight of the product can also apply a force to the bottom handle 14, such that the weight of the product can further press on the handle 14 and maintain the handle 14 in the folded position in the first direction X. As will be discussed herein, the top handle 12 can also contain a similar machine fold 34*a*-34*b* that also allows it to fold consistently in the same first direction X as the bottom handle 14.

Additionally, as the container 10 is evacuated and less product remains, the bottom handle 14 can continue to provide support to help the container 10 to remain standing upright unsupported and without tipping over. Because the bottom handle 14 is sealed generally along its entire length extending between the pair of side panels 18 and 20, it can help to keep the gussets 54 and 56 (FIG. 3) together and continue to provide support to stand the container 10 upright even as the container 10 is emptied.

Figure 4:
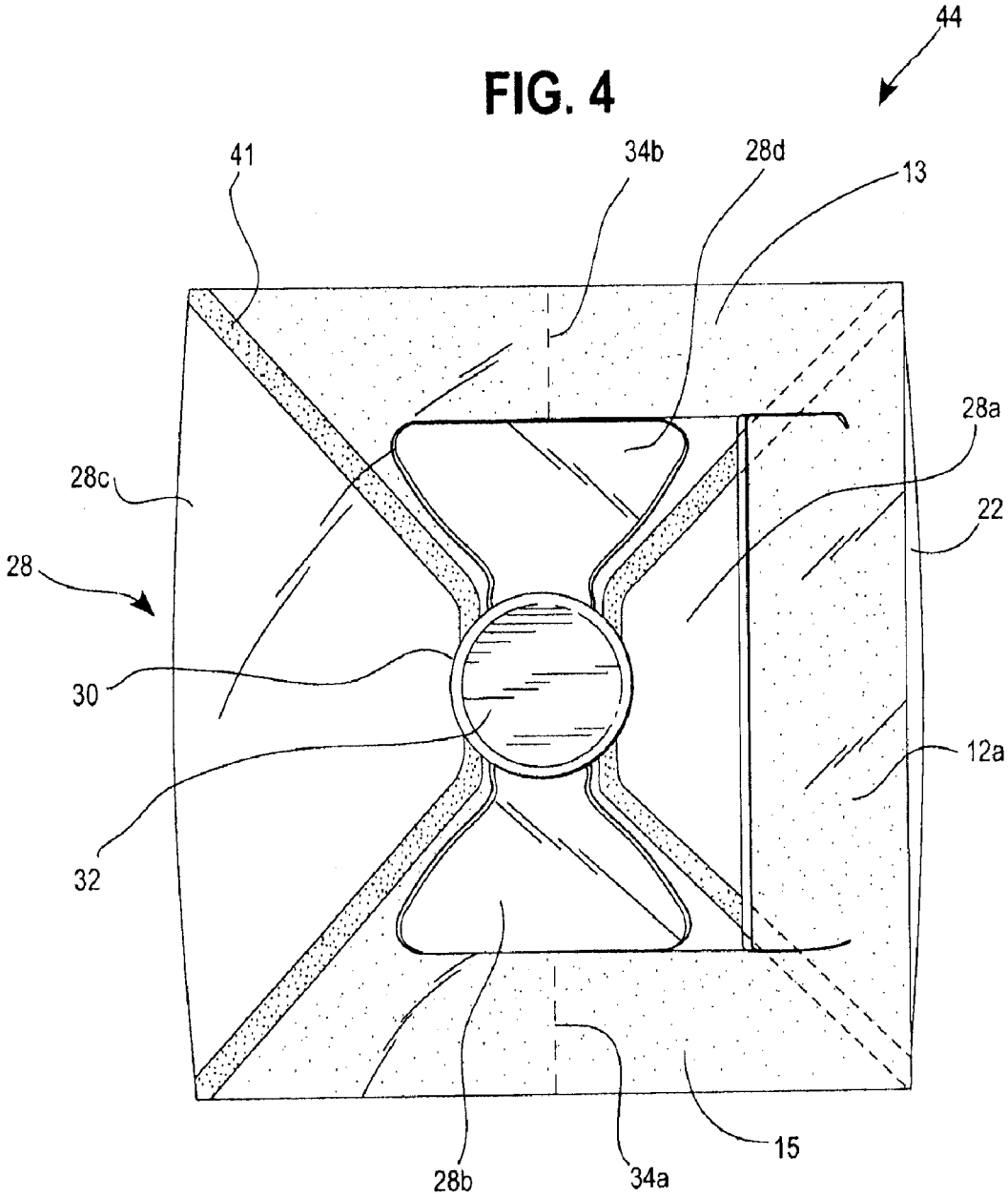
FIG. 4 is a top plan view of the flexible container of FIG. 1.

As seen in FIGS. 3-4, the top handle 12 can extend from the top segment 28 and, in particular, can extend from the four panels 28*a*-28*d* that make up the top segment 28. The four panels 28*a*-28*d* of film that extend into the top handle 12 are all sealed together to form a multi-layer top handle 12. The top handle 12 can have a U-shape and, in particular, an upside down U-shape with a horizontal upper handle portion 12*a* having two pairs of spaced legs 13 and 15 extending therefrom. The pair of legs 13 and 15 extend from the top segment 28, adjacent the spout 30 with one of the pair of legs 13*a* and 13*b* on one side of the spout 30 and the other of the pair of legs 15*a* and 15*b* on the other side of the spout 30, with each pair 13*a-b* and 15*a-b* extending from opposite portions of the top segment 28.

The bottommost edge of the upper handle portion 12*a* when extended in a position above the spout 30, can be just tall enough to clear the uppermost edge of the spout 30. A portion of the top handle 12 can extend above the spout 30 and above the top segment 28 when the handle 12 is extended in a position perpendicular to the top segment 28 and, in particular, the entire upper handle portion 12*a* can be above the spout 30 and the top segment 28. The two pairs of legs 13 and 15 along with the upper handle portion 12*a* together make up the handle 12 surrounding a handle opening that allows a user to place their hand therethrough and grasp the upper handle portion 12*a* of the handle 12.

As with the bottom handle 14, the top handle 12 also can have a dead machine fold 34 that permits folding in a first direction toward the front side panel 22 and restricts folding in a second direction toward the rear side panel 24. The machine fold 34*a*-34*b* can be located in each of the pair of legs 13*a*-13*b* and 15*a*-15*b* at a location where the seal begins. The handle 12 can be adhered together, such as with a tack adhesive, beginning from the machine folded portion 34 up to and including the horizontal upper handle portion 12*a* of the handle 12. The positioning of the machine fold 34 can be in the same latitude plane as the spout 30 and, in particular, as the bottommost portion of the spout 30. The two machine folds 34*a*-34*b* in the handle 12 can allow for the handle 12 to be inclined to fold or bend consistently in the same first direction X as the bottom handle 14, rather than in the second direction Y. As shown in FIGS. 1 and 3, the handle 12 can likewise contain a flap portion 36, that folds upwards toward the upper handle portion 12*a* of the handle 12 to create a smooth gripping surface of the handle 12, as with the bottom handle 14, such that the handle material is not sharp and can protect the user's hand from getting cut on any sharp edges of the handle 12.

When the container 10 is in a rest position, such as when it is standing upright on its bottom segment 26, as shown in FIG. 1, the bottom handle 14 can be folded underneath the container 10 along the bottom machine fold 42 in the first direction X, so that it is parallel to the bottom segment 26 and adjacent bottom panel 26*a*, and the top handle 12 will automatically fold along Its machine fold 34*a*-34*b* in the same first direction X, with a front surface of the handle 12 parallel to a top section or panel 28*a* of the top segment 28. The top handle 12 folds in the first direction X, rather than extending straight up, perpendicular to the top segment 28, because of the machine folds 34*a*-34*b*. Both handles 12 and 14 are inclined to fold in the same direction X, such that upon dispensing the handles can fold the same direction, relatively parallel to its respective end panel or end segment, to make dispensing easier and more controlled. Therefore, in a rest position, the handles 12 and 14 are both folded generally parallel to one another. Additionally, the container 10 can stand upright even with the bottom handle 14 positioned underneath the upright container 10.

Alternatively, in another aspect the container can contain a fitment or pour spout positioned on a sidewall, where the top handle is essentially formed in and from the top portion or segment. The top handle can be formed from the four webs of film, each extending from its respective sidewall, extending into a sidewall or flap positioned at the top end of the container, such that the top segment of the container converges into the handle and they are one and the same, with the spout to the side of the extended handles, rather than underneath.

The material of construction of the container 10 can comprise any conventional food-grade plastic. For instance, nylon, polyethylene, high density polyethylene (HDPE) and/or low density polyethylene (LDPE) may be used. The film of the plastic container 10 can have a thickness that is adequate to maintain product and package integrity during manufacturing, distribution, product shelf life and customer usage, such as about 4.0 to about 9.0 mils. The film material can also be such that it provides the appropriate atmosphere within the container 10 to maintain the product shelf life of at least about 180 days. Such films can comprise an oxygen barrier film, such as a film having a low oxygen transmission rate (OTR) of about 0 to about 1 cc/100 $in^2$/24 hrs at 73° F. and 80% relative humidity (RH). Additionally, the film can also comprise a water vapor barrier film, such as a film having a low water vapor transmission rate (WVTR) of about 0 to about 1 g/100 $in^2$/24 hrs at 100° F. and 90% RH. The film used can be either printable or compatible to receive a pressure sensitive label or other type of label for displaying of indicia on the container 10.

Figure 7:
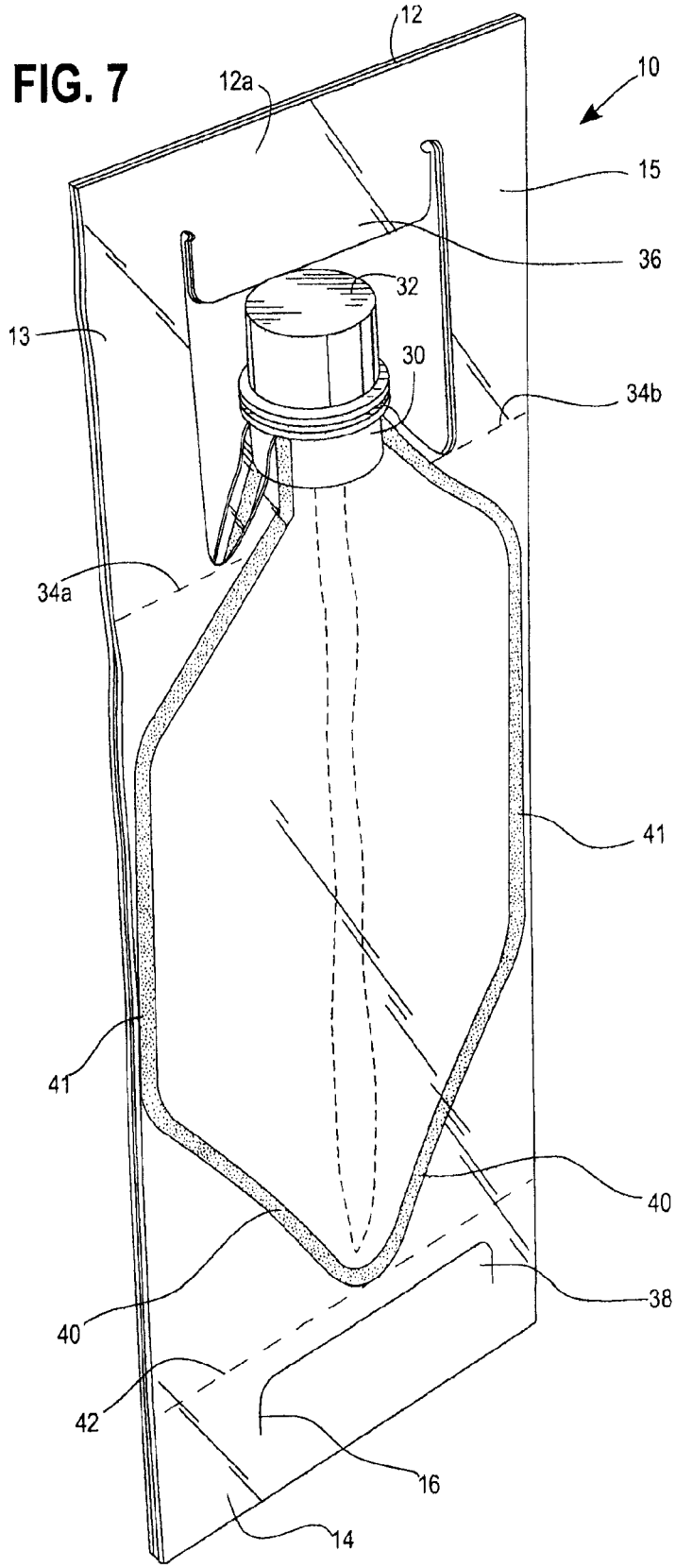
FIG. 7 is a perspective view of the container of FIG. 1 in an evacuated state.

The container 10 can be any size that is appropriate for the food product being stored therein and, in one aspect, can be at least one gallon size or larger. In that aspect, the one gallon size container 10 can have a length of about 16½ inches when in a flattened, evacuated state as shown in FIG. 7, and a width of about 6½ inches. The top handle 12 can have a length of about 6½ inches with an opening section that is about 3½ inches long for gripping. Likewise, the bottom handle 14 can also be about 6½ inches long with its opening 16 or cutout about 3½ inches long; the height of the opening 16 can be about ¾ inches to about 1 inch, or at least large enough to accommodate a user's hand. In general, the container 10 can have a generally quadrilateral shape when relatively full, although any suitable shape may be provided. In one aspect, the container 10 can have a generally rectangular or square shape. In another aspect, the edges of the container 10 can be more rounded when full due to the flowable nature of the substance therein acting upon the flexible panels of the container 10 to modify or change its shape.

Figure 5:
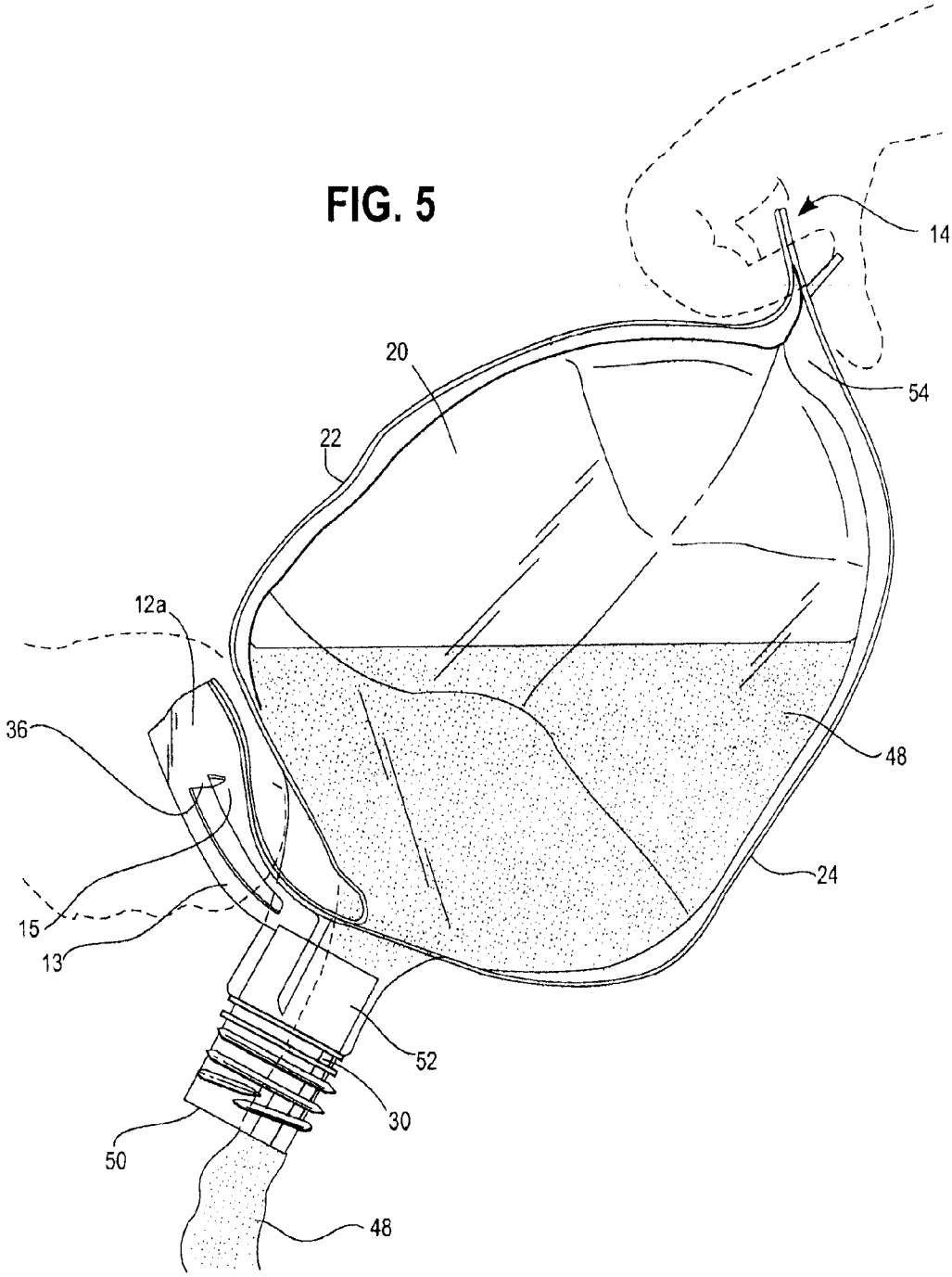
FIG. 5 is a side plan view of the flexible container of FIG. 11*n* an inverted position for transferring the contents.

The spout 30, in FIGS. 5 and 7, of the container 10 can be sized such that a user's hand cannot be inserted through the access opening 50 into the interior of the container 10. The spout 30 typically will be sized small for better pouring control and can have a diameter of up to about 2.5 inches. In one aspect, the area of the access opening 50 of the spout 30 relative to the area of the top segment 28 can comprise up to about 20% of the top segment 28 surface area. The spout 30 can be of a rigid construction and can be formed of any appropriate plastic, such as HDPE or LDPE. The location of the spout 30 can be anywhere on the top segment 28 of the container 10, however, it is preferred to be located at the center or midpoint of the top segment 28. Alternatively, the spout can be positioned anywhere on a sidewall of the container, but preferably at an upper section of the sidewall closer to the top segment than to the bottom segment, Additionally, the spout 30 can have a cap or closure 32 to cover the spout opening 50 and to prevent the product from spilling out of the container 10. The cap 32 may be a screw-on cap, a flip-top cap or other types of removable (and optionally reclosable) closures.

The container 10 can be used to store any number of flowable substances therein. In particular, a flowable food can be stored within the container 10. In one aspect, flowable food products such as salad dressings, sauces, mayonnaise, mustard, ketchup, other condiments, beverages, and the like can be stored inside of the container 10.

During the sealing process, i.e., heat-sealing with dies, when the multiple film layers are pressed together to form the seals and/or handles, air bubbles or air pockets may form. In order to compensate for the air pockets, the die used for sealing can have a pattern thereon that allows the air from these pockets to escape, however, often leaving behind a pattern in the film that matches that shown on the die. For instance, small circles may be imprinted upon the sealed edges and handles of the container that correlate to the pattern on the die used for heat-sealing. Any other pattern can be provided as long as it is appropriate for evacuating the air from the pockets within the film. Alternatively, a pattern from the die may not transfer at all to the container.

A method of pouring or transferring the contents from the container 10 to another smaller container or receiving receptacle is also disclosed herein, and illustrated in FIG. 5. Before the product can be transferred, the user can remove the cap 32 from the spout 30, if present, and can grasp the container 10 by its top handle 12 to lift the container 10 up, thus exposing the bottom handle 14. Before transferring the contents of the container 10 to a smaller receiving receptacle, the user can continue to grasp the top handle 12 with one hand while also grasping the bottom handle 14 with the other hand by inserting their hand or a portion of their hand through the opening 16 in the bottom handle 14. The user can then rotate or invert the container 10 at an angle greater than 0 degrees to begin pouring the contents out from the container 10 through the access opening 50 of the spout 30.

As shown in FIGS. 1 and 3, the top and bottom handles 12 and 14 can both be folded along their respective machine folds 34*a*-34*b* and 42 in the same direction, i.e., the first direction X, such that both handles 12 and 14 can be adjacent their respective top or bottom segment 28 or 26 while pouring. This orientation of the handles 12 and, 14 allows the top handle 12 to clear the access opening 50 of the spout 30 such that the contents therein can be poured out without coming in contact with the top handle 12. The grasping of both the top and bottom handles 12 and 14 as the contents are being transferred can provide for adequate support of the container 10 and allow the user to better direct the pouring of the contents. The container 10 can be poured at an angle greater than 0 degrees and up to about 180 degrees.

At any time during evacuation of the product, the user can aid in the evacuation by applying pressure to the walls or segments 18, 20, 22, 24, 26, 28 of the container 10 to squeeze out additional product. In order to squeeze the container walls or segments 18, 20, 22, 24, 26, 28, the user will need to remove one of their hands from the handles 12 or 14. In most cases the user will continue to hold the bottom handle 14, since it is most convenient to continue holding at the bottom end 46 while holding the container 10 upside down or at an angle maintaining the spout 30 in a downward position, in which case the user would let go of the top handle 12. Because of the machine fold 34 in the top handle 12, the handle 12 will revert back to the folded position in the first direction X once the user releases the handle 12. As a result, when the product is squeezed from the container 10 it can exit the spout 30 without any interference from the top handle 12 and without effecting any dripping down the side of the container 10. This allows a sanitary transfer of product and ensures that the top handle 12 will not dangle or hang down in the path of the access opening 50 due to the force of gravity as a result of its machine fold 34. This procedure allows for at least 95% evacuation of the product inside and, in particular, allows for complete (i.e., 100%) evacuation of product.

From the foregoing, it will be appreciated a flexible container having flexible handles is provided. However, numerous modifications and variations could be made thereto by those skilled in the art without departing from the scope of the container set forth in the claims. Therefore, the disclosure is not limited to the aspects and embodiments described hereinabove, or to any particular embodiments. Various modifications to the container could be made which can result in substantially the same container and flexible handles.

The invention claimed is:

1. A flexible container having flexible top and bottom handle structures for facilitating dispensing of a flowable substance stored therein, the container comprising:

a plurality of flexible panels enclosing an interior of the container and forming a top segment, an opposite bottom segment, a front side segment, a rear side segment, and a pair of side segments bounding the interior;

a rigid fitment providing an access opening through either the top segment or a front side segment;

a flexible bottom handle structure surrounding a handle opening and defined by at least one of the flexible panels, the bottom handle structure being positioned along a center portion of the bottom segment between the front side and rear side segments, the bottom handle structure having a folded portion at the opening to provide a smooth gripping surface; and a flexible top handle structure surrounding a handle opening with two pairs of spaced legs and defined by at least one of the flexible panels, the top handle structure being positioned adjacent the fitment with one of the two pairs of legs on one side of the fitment and the other of the two pairs of legs on the other side of the fitment, the top handle structure having a folded portion at the opening to provide a smooth gripping surface.

2. The container according to claim 1, wherein the bottom handle and the top handle both have a machine fold permitting folding in a first direction toward the front side segment and restricting folding in a second direction toward the rear side segment.

3. The container according to claim 1, wherein the container is made from four flexible films, each film comprising one side segment.

4. The container according to claim 1, wherein the four side segments converge together at a top and a bottom end of the container to form the top segment and the bottom segment, respectively, and the bottom handle structure extends from the bottom segment and the top handle structure extends from the top segment.

5. The container according to claim 1, wherein one of the two pairs of legs of the top handle structure extends from a portion of the top segment and the other of the two pairs of legs of the top handle structure extends from an opposite portion of the top segment.

6. The container according to claim 1, wherein the fitment contains a removable closure.

7. The container according to claim 1, wherein the container has a generally quadrilateral shape.

8. The container according to claim 1, wherein the flexible top and bottom handle structures allow for dispensing of at least about 95% of the flowable substance without constricting the flow of the flowable substance from the container.

9. The container according to claim 1, wherein the bottom handle structure is shaped as a rectangle with a generally rectangular opening.

10. The container according to claim 1, wherein the rigid fitment is positioned on the top segment.

11. A flexible container having a flexible top handle structure for facilitating dispensing of a flowable substance stored therein, the container comprising:

a plurality of flexible panels enclosing an interior of the container and forming a top segment, an opposite bottom segment, a front side segment, a rear side segment, and a pair of side segments bounding the interior;

a rigid fitment providing an access opening through either the top segment or the front side segment; and a flexible top handle structure surrounding a handle opening with two pairs of spaced legs and defined by at least one of the flexible panels, the top handle structure being positioned adjacent the fitment with one of the two pairs of legs on one side of the fitment and the other of the two pairs of legs on the other side of the fitment, the top handle structure having a machine fold permitting folding in a first direction toward the front side segment and restricting folding in a second direction toward the rear side segment.

12. The container according to claim 11, wherein a portion of the top handle structure extends above the fitment and above the top segment.

13. The container according to claim 11, wherein the opening in the flexible top handle structure is sized to accommodate a user's hand.

14. The container according to claim 11, wherein the top handle structure has a folded portion at its opening that provides a smooth gripping surface.

15. The container according to claim 11, wherein the container has a flexible bottom handle defined by at least one of the flexible panels.

16. The container according to claim 15, wherein the opening of the flexible bottom handle is sized to accommodate a user's hand, the flexible bottom handle having a folded portion at its opening that provides a smooth gripping surface.

17. The container according to claim 15, wherein the bottom handled has a machine fold permitting folding in a first direction toward the front side segment and restricting folding in a second direction toward the rear side segment.

18. A flexible container having flexible handle structures for facilitating dispensing of a flowable substance stored therein, the container comprising:

a plurality of flexible panels enclosing an interior of the container and forming a top segment, an opposite bottom segment, a front side segment, a rear side segment, and a pair of side segments bounding the interior;

a rigid fitment providing an access opening through the top segment;

a flexible bottom handle structure surrounding a handle opening and defined by at least one of the flexible panels, the bottom handle structure being positioned along a center portion of the bottom segment between the front side and rear side segments, the bottom handle structure having a machine fold permitting folding in a first direction toward the front side segment and restricting folding in a second direction toward the rear side segment; and a flexible top handle structure surrounding a handle opening with two pairs of spaced legs and defined by at least one of the flexible panels, the top handle structure being positioned adjacent the fitment of the top segment with one of the two pairs of legs on one side of the fitment and the other of the two pairs of legs on the other side of the fitment, the top handle structure having a machine fold permitting folding in a first direction toward the front side segment and restricting folding in a second direction toward the rear side segment.

19. The container according to claim 18, wherein the openings of the flexible top and bottom handle structures are each sized to accommodate a user's hand and wherein the top and bottom handle structures each has a folded portion at its respective opening that provides a smooth gripping surface.

20. A method of transferring a flowable substance from a flexible container, the method comprising:

providing a flexible container with a bottom portion, a top portion, and four sidewalls extending between the bottom and top portions having a flexible bottom handle integrally formed with the bottom portion and a flexible top handle integrally formed with the top portion adjacent a rigid pour spout positioned on the top portion, the flexible top and bottom handles both having machine folds that allow them to be consistently folded in a first direction rather than a second direction;

removing a closure from the rigid pour spout;

grasping the flexible top handle with a first hand to lift the container up and exposing the flexible bottom handle;

grasping the flexible bottom handle with a second hand and using both the top and bottom handles to invert the container and to position the pour spout above a receiving receptacle; and transferring a desired quantity of the flowable substance from the container through the pour spout and into the receiving receptacle.

* * * * *